US009491808B2

(12) United States Patent
Ogasawara et al.

(10) Patent No.: US 9,491,808 B2
(45) Date of Patent: Nov. 8, 2016

(54) INDUCTION HEATING COOKWARE

(75) Inventors: Fumitaka Ogasawara, Hyogo (JP); Shintaro Noguchi, Hyogo (JP); Teruo Hayashinaka, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1078 days.

(21) Appl. No.: 13/636,300

(22) PCT Filed: Mar. 31, 2011

(86) PCT No.: PCT/JP2011/001948
§ 371 (c)(1),
(2), (4) Date: Sep. 20, 2012

(87) PCT Pub. No.: WO2011/122043
PCT Pub. Date: Oct. 6, 2011

(65) Prior Publication Data

US 2013/0008889 A1 Jan. 10, 2013

(30) Foreign Application Priority Data

Mar. 31, 2010 (JP) ..... 2010-082380

(51) Int. Cl.
*H05B 6/12* (2006.01)
*H05B 6/42* (2006.01)
*H05B 6/06* (2006.01)

(52) U.S. Cl.
CPC ..... *H05B 6/062* (2013.01); *H05B 2213/04* (2013.01); *H05B 2213/07* (2013.01)

(58) Field of Classification Search
CPC ..... H05B 6/062; H05B 6/12; H05B 6/1209; H05B 6/1218; H05B 2213/04; H05B 2213/07
USPC ..... 373/413, 428, 497, 506, 620, 622, 627, 373/667, 660, 661, 663, 664, 675
See application file for complete search history.

(56) References Cited

U.S. PATENT DOCUMENTS

2006/0081607 A1* 4/2006 Niiyama ..... H05B 6/062 219/497
2009/0014438 A1* 1/2009 Ohashi ..... H05B 6/062 219/627

FOREIGN PATENT DOCUMENTS

CN 1701639 A 11/2005
JP H09-437 A 1/1997

(Continued)

OTHER PUBLICATIONS

International Search Report for International Application No. PCT/JP2011/001948, dated May 17, 2011, 1 page.
International Preliminary Report on Patentability for International Application No. PCT/JP2011/001948, dated Oct. 23, 2012, 7 pages.

(Continued)

*Primary Examiner* — Hung D Nguyen
(74) *Attorney, Agent, or Firm* — Brinks Gilson & Lione

(57) ABSTRACT

An induction heating cooker includes a scorching detection portion adapted to output scorching detection information, when the temperature of a cooking container comes to be equal to or higher than a second set temperature, based on infrared-ray detection information (A) from an infrared sensor for detecting infrared rays from the cooking container, in a heating mode which enables setting the output. A control portion is adapted to perform heating-output suppression operations for preventing the progress of scorching, when the scorching detection portion outputs scorching detection information. Further, the control portion is adapted to prohibit such heating-output suppression operations and to continue heating operations, even if the scorching detection portion outputs scorching detection information, until the measured cooking time period after start of heating operations reaches a first set elapsed time period (T1).

13 Claims, 8 Drawing Sheets

(56) References Cited

FOREIGN PATENT DOCUMENTS

| | | | |
|---|---|---|---|
| JP | 10-149875 | A | 6/1998 |
| JP | 2000-100554 | A | 4/2000 |
| JP | 2003-234168 | A | 8/2003 |
| JP | 2004-063199 | A | 2/2004 |
| JP | 2007-103289 | a | 4/2007 |
| JP | 2007-115515 | A | 5/2007 |

OTHER PUBLICATIONS

Extended Search Report in corresponding European Application No. 11 76 2285 dated Oct. 29, 2015, 4 pages.

Office Action and Search Report, and partial translation thereof, in corresponding Chinese Application No. 201180016739.6, dated May 28, 2014, 9 pages.

Office Action in corresponding Canadian Application No. 2,794,691, dated Jun. 12, 2014, 3 pages.

* cited by examiner

INDUCTION HEATING COOKWARE

This application is a 371 application of PCT/JP2011/001948 having an international filing date of Mar. 31, 2011, which claims priority to JP2010-082380 filed Mar. 31, 2010, the entire contents of which are incorporated herein by reference.

TECHNICAL FIELD

The present invention relates to induction heating cookware, and more particularly relates to induction heating cookers that have a function of detecting scorching of heating containers such as pans, during heating cooking.

BACKGROUND ART

Conventionally, induction heating cookers of this type have been adapted to perform boiling detection operations after start of heating, to determine the viscosities and the volumes of objects to be cooked within cooking containers (such as pans) based on the temperature and input electric power at the time boiling is detected, and temperature changing patterns until the occurrence of the boiling, and to determine electric power necessary to perform heating after the boiling. Conventional induction heating cookers have been adapted to have a stewing mode for performing scorching detection in order to determine the occurrence of scorching of an object to be cooked to the pan bottom, if the temperature of the bottom surface of the cooking container (the pan bottom) is abruptly raised to above a predetermined value, since a soup stock has been run out within the cooking container being heated (refer to Unexamined Japanese Patent Publication No. H10-149875 (hereinafter, abbreviated as Patent Literature 1), for example). Further, for conventional induction heating cookers, there have been suggested structures for determining the occurrence of scorching, if a detected temperature of a cooking container being heated abruptly rises (refer to Unexamined Japanese Patent Publication No. 2007-115515 (hereinafter, abbreviated as Patent Literature 2), for example).

FIG. 9 is a block diagram of a conventional induction heating cooker, and FIG. 10 is a flow chart illustrating operations of the conventional induction heating cooker illustrated in FIG. 9.

Referring to FIG. 9, a top plate 101 is a plate made of a crystallized ceramic, which is provided in an upper surface of the induction heating cooker, and a heating coil 103 is provided under the top plate 101. When a pan 102 as a cooking container is heated, the pan 102 is placed on the top plate 101, such that a bottom of the pan faces the heating coil 103. An inverter circuit 108*a*, which includes a switching device and a resonant capacitor, constitutes an inverter in cooperation with the heating coil 103 and supplies a high-frequency electric current to the heating coil 103. A control portion 107 performs ON and OFF control on the switching device in the inverter circuit 108*a* for controlling the heating output. In order to detect the temperature of the bottom surface of the pan 102 as a cooking container, a thermistor 104 as a thermo-sensitive device is provided on the back surface of the top plate 101 on which the pan 102 is placed such that the thermistor 104 is in contact with the back surface to determine the temperature of the back surface of the top plate 101. The thermistor 104 outputs, to the control portion 107, detection signals corresponding to the temperature of the back surface of the top plate 101. A manipulation portion 101 manipulated by a user is provided with an output setting portion 110*a*, a heating-start key 110*b* for starting heating operations, and a control-mode selection key 110*c* for selecting operation modes. The output setting portion 110*a* is provided with a down key 110*aa* that decreases the set output value by a single step every time the down key 110*aa* is pressed, during operations in a heating mode, and an up key 110*ab* which increases the set output value by a single step every time the up key 110*ab* is pressed.

Next, operations of the conventional induction heating cooker having the structure as described above will be described, with reference to FIG. 10. If a power-supply switch 106 is turned on (S301), the control portion 107 is brought into a standby mode. In the standby mode, the control portion 107 stops heating operations, in a state where it is possible to select a single operation mode, out of a plurality of operation modes including a heating mode and a stewing mode, by manipulating the control-mode selection key 110*c* in the manipulation portion 110. In the standby mode, when an operation mode is selected (S302), and the heating-start key 110*b* is pressed (S303), a heating operation is started in the selected operation mode. For example, when the stewing mode is selected and a heating operation is started (Yes in S304), the control portion 107 prohibits changing the set output value through the output setting portion 110*a*, and performs a boiling detection operation and then automatically controls the heating output, as described in Patent Literature 1. If an abnormal temperature rise in the pan 102 is detected from detection signals from the thermistor 104, a scorching detection function for detecting scorching is exerted (S306). If, for example, the heating mode, rather than the stewing mode, is selected, and a heating operation is started (No in S304), the control portion 107 prohibits the scorching detection function from being exerted (S305). At this time, changing of the set output value through the output setting portion 110*a* is allowed.

PLT 1: Unexamined Japanese Patent Publication No. H10-149875

PLT 2: Unexamined Japanese Patent Publication No. 2007-115515

SUMMARY OF INVENTION

Technical Problem

However, the conventional induction heating cooker having the structure is adapted to restrict cooking modes in which the scorching detection function is operated, to the stewing mode, and to prohibit changing of the set output value through the output setting portion 110*a* in the stewing mode. Namely, the user has not been enabled to exert the scorching detection function, in the heating mode in which the set output value can be changed through the output setting portion 110*a*. Accordingly, the user has had to select the stewing mode, in order to operate the scorching detection function in the induction heating cooker. In the stewing mode, as long as no scorching has occurred at temperatures of the cooking container during stewing, no abrupt temperature rise occurs and, if an abrupt temperature rise occurs, this indicates the occurrence of scorching. Therefore, in the stewing mode, it is possible to perform scorching detection by detecting abrupt temperature rises. However, in other operation modes, such as the heating mode, for example, the temperature of the cooking container is changed variously depending on the type of the heating cooking. For example, the temperature can be abruptly raised to higher temperatures, such as during sauteing cooking. Therefore, it has been difficult to accurately detect the occurrence of scorching, which is estimated to necessitate suppression of the heating output.

Further, as described in the Patent Literature 2, with conventional induction heating cookers which are structured to determine the occurrence of scorching in the event of abrupt rises of the detected temperature of the cooking container, there is a higher possibility of determinations that scorching has occurred in the cooking pan container during sauteing cooking, which may cause heating operations to be unnecessarily stopped, thereby making it impossible to continue heating operations with necessary heating output until the completion of the sauteing cooking. Therefore, such conventional induction heating cookers have not been induction heating cookers with excellent usability.

The present invention was made in order to overcome problems in conventional induction heating cookers having structures as described above. Thus, the present invention aims at providing an induction heating cooker which is capable of exerting a scorching detection function in the case where it is estimated that there is a need for the scorching detection function for performing heating-output suppression operations on detecting scorching, even during cooking in a heating mode which enables a user to arbitrarily select a heating output, and which is capable of prohibiting the scorching detection function in the case where the scorching detection function may be unnecessarily exerted to adversely affect cooking operations. Namely, the present invention aims at providing an induction heating cooker with excellent usability which is capable of alleviating adverse influences of the scorching detection function on sauteing cooking, and also is capable of preventing scorching from being progressed to a higher degree during stewing cooking, wherein such sauteing cooking is one of normal cooking operations which are performed in a heating mode, and such stewing cooking is another normal cooking operation which is performed in the heating mode.

Solution to Problem

In order to overcome the problems in conventional induction heating cookers, an induction heating cooker according to the present invention includes: a top plate on which a cooking container is placed; an inverter which is provided under the top plate and includes a heating coil for heating the cooking container; an infrared sensor which is provided under the top plate and is adapted to output infrared-ray detection information indicative of a temperature of the cooking container, on detecting an infrared ray radiated from a bottom surface of the cooking container and passed through the top plate; a scorching detection portion adapted to output scorching detection information indicative of an occurrence of scorching of an object to be cooked to the cooking container, on detecting that the temperature indicated by the infrared-ray detection information has increased to be equal to or higher than a second set value; an output setting portion for selecting a single set output value, out of a plurality of different set output values; and a control portion which is adapted to control a heating operation by the inverter in such a way as to supply a high-frequency electric current to the heating coil and to make a heating output equal to a set output value selected through the output setting portion, and is adapted to perform a heating-output suppression operation for suppressing the heating output or stopping the heating operation by the inverter for preventing scorching from being progressed, based on the scorching detection information; wherein the control portion includes a detected-temperature calculation portion adapted to convert the infrared-ray detection information into a temperature, and a first time-measurement portion adapted to measure a cooking time period after start of the heating operation by the inverter, and the control portion performs the heating-output suppression operation based on the scorching detection information, when the measured cooking time period measured by the first time-measurement portion is equal to or more than a first set elapsed time period.

The induction heating cooker having the structure described according to the present invention is capable of detecting scorching and preventing the scorching from being progressed, during cooking in a heating mode for performing heating with a heating output selected by a user. Further, the induction heating cooker is capable of prohibiting heating-output suppression operations based on scorching detection information, for a predetermined time period, during cooking such as boiling water or sauteing which is performed by completing heating operations in relatively-shorter time periods and thus necessitates no scorching detection function, which can prevent heating operations from being unnecessarily stopped or can prevent the heating output from being reduced, due to actuation of the scorching detection function. As described above, the induction heating cooker according to the present invention enables the user to continue cooking without having an uncomfortable feeling and exhibits improved usability.

In the following description about means for solving the problems, according to the present invention, concrete names of components and signals in embodiments which will be described later are described in parentheses for indicating the association therebetween. However, the structure of the present invention is not intended to be limited to those which will be described in these embodiments.

An induction heating cooker in a first aspect according to the present invention includes:

a top plate (1) on which a cooking container (2) is placed;

an inverter (3, 8) which is provided under the top plate and includes a heating coil (3) for heating the cooking container;

an infrared sensor (4) which is provided under the top plate and is adapted to output infrared-ray detection information (A) indicative of a temperature of the cooking container, on detecting an infrared ray radiated from a bottom surface of the cooking container and passed through the top plate;

a scorching detection portion (50) adapted to output scorching detection information (B) indicative of an occurrence of scorching of an object to be cooked to the cooking container, on detecting that the temperature indicated by the infrared-ray detection information has increased to be equal to or higher than a second set value (a second set temperature: Temp 2);

an output setting portion (14) for selecting a single set output value, out of a plurality of different set output values; and a control portion (15) which is adapted to control a heating operation by the inverter in such a way as to supply a high-frequency electric current to the heating coil and to make a heating output equal to a set output value selected through the output setting portion and, further, is adapted to perform a heating-output suppression operation for suppressing the heating output or stopping the heating operation by the inverter for preventing scorching from being progressed, based on the scorching detection information;

wherein the control portion includes a detected-temperature calculation portion (30) adapted to convert the infrared-ray detection information into a temperature, and a first time-measurement portion (31) adapted to measure a cooking time period (Tp) after start of the heating operation by the inverter, and the control portion performs the heating-output suppression operation based on the scorching detection information, when the measured cooking time period measured by the first time-measurement portion is equal to or more than a first set elapsed time period (T1). The induction heating cooker having the structure in the first aspect is capable of detecting scorching based on scorching detection information and performing heating-output suppression operations for preventing the scorching from being progressed, during stewing cooking, in the heating mode. Further, the induction heating cooker is capable of prohibiting heating-output suppression operations based on scorching detection information for preventing scorching detection from being unnecessarily exerted in shorter time periods, during cooking which involves raising the cooking-container bottom surface to higher temperatures in comparison with stewing cooking, such as during sauteing cooking. Therefore, the induction heating cooker has improved usability.

An induction heating cooker in a second aspect according to the present invention includes:

a top plate (1) on which a cooking container (2) is placed;

an inverter (3, 8) which is provided under the top plate and includes a heating coil (3) for heating the cooking container;

an infrared sensor (4) which is provided under the top plate and is adapted to output infrared-ray detection information (A) indicative of a temperature of the cooking container, on detecting an infrared ray radiated from a bottom surface of the cooking container and passed through the top plate;

a scorching detection portion (50) adapted to output scorching detection information (B) indicative of an occurrence of scorching of an object to be cooked to the cooking container, on detecting that the temperature indicated by the infrared-ray detection information has increased to be equal to or higher than a second set value (a second set temperature: Temp 2);

an output setting portion (14) for selecting a single set output value, out of a plurality of different set output values; and a control portion (15) which is adapted to control a heating operation by the inverter in such a way as to supply a high-frequency electric current to the heating coil and to make a heating output equal to a set output value selected through the output setting portion, and is adapted to perform a heating-output suppression operation for suppressing the heating output or stopping the heating operation by the inverter for preventing scorching from being progressed, based on the scorching detection information;

wherein the control portion (15) includes a detected-temperature calculation portion (30) adapted to convert the infrared-ray detection information into a temperature, and a second time-measurement portion (32) adapted to measure a cooking-continuing time period (Tq) after the temperature indicated by the infrared-ray detection information (A) reaches the second set value, and the control portion performs the heating-output suppression operation based on the scorching detection information (B), when the measured cooking-continuing time period measured by the second time-measurement portion is equal to or longer than a second set elapsed time period (T2). The induction heating cooker having the structure in the second aspect is capable of alleviating the risk of unnecessary actuation of scorching detection in shorter time periods, during cooking which involves raising the cooking-container bottom surface to higher temperatures, such as during sauteing cooking.

According to a third aspect of the present invention, in the induction heating cooker in the first aspect, the control portion (15) is adapted to control the heating operation by the inverter such that the temperature indicated by the infrared-ray detection information (A) comes to be a temperature between the second set value (the second set temperature: Temp 2) and a third set value (a third set temperature: Temp 3) which is equal to or lower than the second set value, when the scorching detection portion (50) has outputted the scorching detection information (B), and when the measured cooking time period (Tp) from the first time-measurement portion (31) is equal to or shorter than a first set elapsed time period (T1). The induction heating cooker having the structure in the third aspect is capable of preventing the heating output from being largely reduced or preventing heating operations from being stopped, due to unnecessary actuation of heating-output suppression operations based on scorching detection information, in shorter time periods, during cooking which involves raising the cooking-container bottom surface to higher temperatures, such as during sauteing cooking. Further, the induction heating cooker is capable of suppressing the progress of scorching as much as possible, even when an occurrence of such scorching has started.

According to a fourth aspect of the present invention, in the induction heating cooker in the first or third aspect, the control portion (15) includes a detected-temperature calculation portion (30) adapted to convert the infrared-ray detection information into a temperature, and a second time-measurement portion (32) adapted to measure a cooking-continuing time period (Tq) after the temperature indicated by the infrared-ray detection information reaches the second set value (Temp 2), and the control portion is adapted to perform the heating-output suppression operation based on the scorching detection information, when the measured cooking time period (Tp) from the first time-measurement portion is equal to or longer than the first set elapsed time period (T1), and also the measured cooking-continuing time period (Tq) from the second time-measurement portion is equal to or longer than the second set elapsed time period (T2). The induction heating cooker having the structure in the fourth aspect is capable of detecting scorching based on scorching detection information and, further, performing heating-output suppression operations for preventing the scorching from being progressed, during stewing cooking which involves a larger amount of water. Further, the induction heating cooker is capable of further alleviating the risk of unnecessary actuation of scorching detection in shorter time periods, during cooking which involves raising the cooking-container bottom surface to higher temperatures, such as during sauteing cooking.

In a fifth aspect of the present invention, in the induction heating cooker in the second aspect, the control portion (15) is adapted to continue the heating operation by the inverter such that the temperature indicated by the infrared-ray detection information (A) comes to be a temperature between the second set value and a third set value which is equal to or lower than the second set value, when the scorching detection portion 50 has outputted the scorching detection information (B), and when the measured cooking-continuing time period (Tq) measured by the second time-measurement portion (32) is equal to or shorter than a second set elapsed time period (T2). The induction heating cooker having the aforementioned structure in the fifth aspect is capable of suppressing (alleviating) the progress of scorching as much as possible even when an occurrence of such scorching has started. Further, the induction heating cooker is capable of alleviating the risk of significant reduction of the heating output and stoppage of heating operations, due to unnecessary actuation of heating-output suppression operations based on scorching detection information, in shorter time periods, during cooking which involves raising the cooking-container bottom surface to higher temperatures, such as during sauteing cooking.

In a sixth aspect of the present invention, in the induction heating cooker in the fifth aspect, the control portion (15) includes a detected-temperature calculation portion (30) adapted to convert the infrared-ray detection information (A) into a temperature, and a first time-measurement portion (31) adapted to measure a cooking time period (Tp) after start of the heating operation by the inverter, and the scorching detection portion (50) confirms the scorching detection, when the measured cooking time period (Tp) from the first time-measurement portion is equal to or longer than the first set elapsed time period (T1) and also the measured cooking-continuing time period (Tq) from the second time-measurement portion is equal to or longer than the second set elapsed time period (T2). The induction heating cooker having the structure in the sixth aspect is capable of detecting scorching based on scorching detection information and, further, performing heating-output suppression operations for preventing the scorching from being progressed, during stewing cooking which involves a larger amount of water. Further, the induction heating cooker is capable of further alleviating the risk of unnecessary actuation of scorching detection in shorter time periods, during cooking which involves raising the cooking-container bottom surface to higher temperatures, such as during sauteing cooking.

In a seventh aspect of the present invention, in the induction heating cooker in the first or second aspect, the control portion (15) is adapted to perform the heating-output suppression operation based on the scorching detection information, only when the control portion (15) determines that stewing cooking is being performed, based on the temperature indicated by the infrared-ray detection information. The induction heating cooker having the structure in the seventh aspect is capable of selectively exerting the scorching detection function, for coping with stewing cooking which involves larger amounts of water and cooking which involves heating the cooking container with higher heating outputs to higher temperatures in shorter time periods (such as sauteing cooking), in the heating mode. Therefore, the induction heating cooker is capable of detecting scorching based on scorching detection information and performing heating-output suppression operations for preventing the scorching from being progressed, during stewing cooking, and is capable of continuing sauteing cooking even when the measured cooking time period measured by the first time-measurement portion is equal to or longer than the first set elapsed time period (T1).

In an eighth aspect of the present invention, in the induction heating cooker in the seventh aspect, the control portion (15) is adapted to determine that stewing cooking is being performed, when the temperature indicated by the infrared-ray detection information is equal to or lower than a first set value which is smaller than the second set value, when the measured cooking time period measured by the first time-measurement portion has reached an initial set elapsed time period. The induction heating cooker having the structure in the seventh aspect is capable of discriminating between stewing cooking which involves a larger amount of water and cooking which involves heating the cooking container with a higher heating output to a higher temperature (such as sauteing cooking).

In a ninth aspect of the present invention, in the induction heating cooker in the seventh aspect, the control portion (15) is adapted to determine that stewing cooking is being performed, when the measured cooking time period measured by the first time-measurement portion until the temperature indicated by the infrared-ray detection information has reached a first set value smaller than the second set value is equal to or longer than an initial set elapsed time period. The induction heating cooker having the structure in the ninth aspect is capable of discriminating between stewing cooking which involves a larger amount of water and cooking which involves heating the cooking container with a higher heating output to a higher temperature (such as sauteing cooking).

Advantageous Effects of the Invention

The induction heating cooker according to the present invention is capable of operating for automatically stopping heating operations or lowering the heating output on detecting scorching, in order to prevent the scorching from being progressed, even when the user performs stewing cooking by selecting a heating output and by selecting the heating mode for heating cooking, which is different from the stewing mode. Further, the induction heating cooker according to the present invention is adapted to prevent the scorching detection function from being unnecessarily exerted, in shorter time periods, during cooking which involves raising the cooking-container bottom surface to higher temperatures with relatively higher heating outputs, such as sauteing cooking. Thus, the induction heating cooker according to the present invention has improved usability.

DETAILED DESCRIPTION OF THE PREFERRED EMBODIMENTS

Hereinafter, with reference to the accompanying drawings, embodiments of an induction heating cooker according to the present invention will be described. It is to be noted that the present invention is not limited to concrete structures which will be described in the following embodiments and is intended to include structures based on technical concepts equivalent to the technical concepts which will be described in the embodiments and based on technical common senses in the present technical field.

First Embodiment

Figure 1:
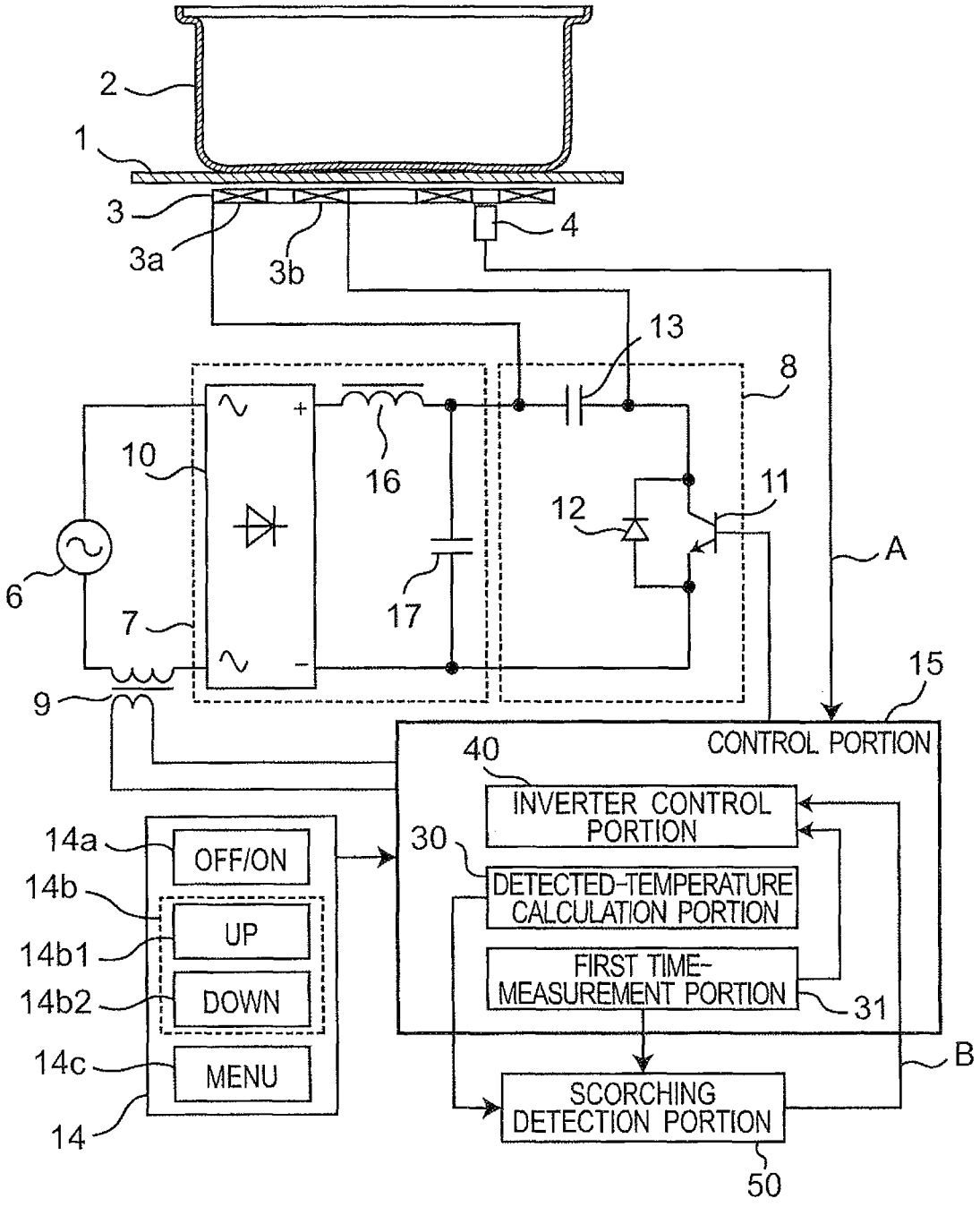
FIG. 1 is a block diagram illustrating the entire structure of an induction heating cooker according to a first embodiment of the present invention.

FIG. 1 is a block diagram illustrating the entire structure of an induction heating cooker according to a first embodiment of the present invention. As illustrated in FIG. 1, the induction heating cooker according to the first embodiment includes a top plate 1 made of a ceramic which is provided on an upper surface of the induction heating cooker, and a heating coil 3 (an outer coil 3*a* and an inner coil 3*b*) which generates a high-frequency magnetic field for inductively heating a cooking container 2 on the top plate 1. The top plate 1 is made of an electric insulating material such as a crystallized ceramic through which infrared rays pass. The heating coil 3 as a coil for induction heating is provided under the top plate 1. The heating coil 3 is concentrically divided into two parts and is constituted by the outer coil 3*a* and the inner coil 3*b* which are electrically connected to each other. A gap is formed between the inner side of the outer coil 3*a* and the outer side of the inner coil 3*b*. The cooking container 2 placed on the top plate 1 is caused to generate heat through eddy currents induced on its bottom surface due to the high-frequency magnetic field from the heating coil 3.

In the top plate 1, in an area closer to a user than the heating coil 3, a manipulation portion 14 is provided for allowing the user to perform various types of manipulations, such as starting/stopping heating operations, making settings. Further, a display portion (not illustrated) is provided between the manipulation portion 14 and the area on which the cooking container 2 is placed.

In the induction heating cooker according to the first embodiment, an infrared sensor 4 as a cooking-container temperature detector is provided under the gap between the outer coil 3*a* and the inner coil 3*b*. Note that, in the induction heating cooker according to the present invention, the position at which the infrared sensor is installed is not limited to that in the structure according to the first embodiment and can be any position at which the infrared sensor is capable of detecting the temperature of the bottom surface of the cooking container 2. Infrared rays radiated from the bottom surface of the cooking container 2, which change their intensities depending on the temperature of the bottom surface of the cooking container 2, pass through the top plate 1, pass through the gap between the outer coil 3*a* and the inner coil 3*b*, and enter the infrared sensor 4 to be received thereby. Further, the heating coil 3 is not limited to one divided into an outer coil 3*a* and an inner coil 3*b*. In the case where the heating coil 3 is not divided, the infrared sensor can be provided such that the infrared sensor detects infrared rays passing through the inside of the winding of the heating coil 3, namely through the heating-coil center or through its vicinity, for example. The infrared sensor 4 detects the infrared rays received and outputs infrared-ray detection signals A as infrared-ray detection information based on the amounts of detected infrared rays.

Under the heating coil 3, there is provided a rectification smoothing portion 7 for converting an AC voltage supplied from a commercial power supply 6 into a DC voltage to form a high-frequency power supply, and an inverter circuit 8 that generates a high-frequency current by being supplied with the DC voltage from the rectification smoothing portion 7 and that outputs the generated high-frequency current to the heating coil 3. Further, between the commercial power supply 6 and the rectification smoothing portion 7, an input-current detection portion 9 (a current transformer) is provided for detecting the input current flowing from the commercial power supply 6 to the rectification smoothing portion 7.

The rectification smoothing portion 7 includes a full-wave rectifier 10 constituted by a bridge diode, and a low-pass filter constituted by a choke coil 16 and a smoothing capacitor 17, which are connected between output terminals of the full-wave rectifier 10. The inverter circuit 8 includes a switching device 11 (an IGBT is employed as the semiconductor switching device in the first embodiment, but it is not limited thereto), a diode 12 connected in inversely parallel with the switching device 11, and a resonant capacitor 13 connected in parallel with the heating coil 3. The switching device 11 in the inverter circuit 8 performs ON/OFF operations, thereby inducing a high-frequency current. The inverter circuit 8 and the heating coil 3 form a high-frequency inverter (which will be also simply referred to as an inverter, hereinafter). Note that, in the first embodiment, the inverter is formed to be of a single-switch type which is constituted by a single switching device, but it is not limited thereto. For example, the inverter can be formed to be of either a two-switch type constituted by two switching devices, such as a half bridge type, or a four-switch type constituted by four switching devices, such as a full-bridge type.

The induction heating cooker according to the first embodiment includes a control portion 15 adapted to control the ON/OFF operations of the switching device 11 in the inverter circuit 8 for controlling the state of the high-frequency current supplied from the inverter circuit 8 to the heating coil 3. The control portion 15 controls the state of the high-frequency current in the heating coil 3 based on operation-mode setting signals and heating-condition setting signals from the manipulating portion 14, and based on infrared-ray detection signals A resulted from detection by the infrared sensor 4, thereby controlling the amplitude of the heating electric power for the cooking container 2 and controlling starting and stopping of heating operations.

The control portion 15 includes an inverter control portion 40 adapted to control the ON/OFF operations of the switching device 11, based on operation-mode setting signals and heating-condition setting signals which are transmitted from the manipulating portion 14, and based on infrared-ray detection signals A from the infrared sensor 4, and the like. Further, the control portion 15 includes a detected-temperature calculation portion 30 adapted to convert infrared-ray detection signals A (voltage signals) from the infrared sensor 4 into temperatures and to output detected-temperature signals, and a first time-measurement portion 31 adapted to measure cooking time periods after start of heating.

Further, the induction heating cooker according to the first embodiment is provided with a scorching detection portion 50. Measured cooking-time-period signals resulted from time measurement by the first time-measurement portion 31 in the control portion 15 and detected-temperature signals created by the detected-temperature calculation portion 30 are inputted to the scorching detection portion 50. Based on these measured cooking-time-period signals and these detected-temperature signals, the scorching detection portion 50 detects that objects to be cooked are in scorched states, and determines whether the current cooking is stewing cooking or other cooking (for example, sauteing cooking) being performed by heating the pan or the like to higher temperatures by the user being near the objects to be cooked, wherein such stewing cooking is cooking which necessitates prevention of scorching of the pan or the like if the user mistakenly leaves the pan during the cooking, while the other cooking less necessitates decreasing of the heating output or stopping of the heating operation in the event of detection of scorching. If the scorching detection portion 50 detects that the bottom portion of the cooking container 2 has been heated to a higher temperature equal to or higher than a predetermined temperature (a second set value Temp 2), and scorching has thus occurred, the scorching detection portion 50 outputs a scorching detection signal B to the inverter control portion 40 in the control portion 15.

As described above, the manipulation portion 14 is provided in the top plate 1 in an area in the front side (in the user-side), and the display portion for displaying operation modes and operation states is provided in the top plate 1 in an area between the manipulation portion 14 and the cooking container 2 placed thereon. The manipulation portion 14 is structured to include a plurality of capacitance-type switches 14*a* to 14*c*. The switches 14*a* to 14*c* are a single set of switches for inputting commands relating to cooking with the single heating coil 3. In the case where there are a plurality of heating coils 3, a plurality of sets of switches are provided in association with the respective heating coils 3. Note that the switches in the manipulation portion 14 according to the present invention are not limited to those of capacitance types, and it is also possible to employ various types of switching means, such as those of press-button types, such as tactile switches.

Respective certain functions are assigned to the switches 14*a* to 14*c*. For example, the function of controlling starting and ending of cooking (heating operations) is assigned to an ON/OFF switch 14*a*. The manipulation portion 14 is provided with an output setting portion 14*b*, and an operation-mode selection key (menu key) 14*c* for selecting an operation mode. The output setting portion 14*b* is provided with a down key 14*b*2 for decreasing the set output value by a single stage, and an up key 14*b*1 for increasing the set output value by a single stage. By manipulating these keys in the output setting portion 14*b*, it is possible to select and set a single set output value, out of a plurality of set output values (for example, Setting 1=100 W, Setting 2=300 W, Setting 3=700 W, Setting 4=1000 W, Setting 5=2000 W, and Setting 6=3000 W in 6 stages).

When the inverter control portion 40 in the control portion 15 detects that the switches 14*a* to 14*c* in the manipulation portion 14 have been pressed (touched), the inverter control portion 40 drives and controls the inverter circuit 8 based on the pressed switches, for controlling the state of the high-frequency current supplied to the heating coil 3.

At first, when a power-supply switch (not illustrated) is brought into an ON state from an OFF state, this brings the operation mode of the control portion 15 into a standby mode which is a state where heating is stopped. In the standby mode, it is possible to select operation modes for controlling operations during heating operations. By manipulating the operation-mode selection key 14*c* in the standby mode, it is possible to select a single operation mode, out of a plurality of operation modes (a heating mode, a stewing mode and the like).

In the standby mode, when the heating mode is selected and the ON/OFF switch 14*a* is pressed (manipulated), a heating operation is started, and the control portion 15 shifts to the heating mode, while automatically setting the set output value to "Setting 4: 1000 W". In this case, the heating mode is an operation mode for performing heating such that the heating output from the inverter circuit 8 comes to be equal to the set output value having been selected by the user through the output setting portion 14*b*. When the control portion 15 operates in the heating mode, it is possible to change the set output value to a desired setting (Settings 1 to 6), by manipulating the output setting portion 14*b*. When the set output value is changed through the output setting portion 14*b*, the output setting portion 14*b* outputs, to the control portion 15, an output setting signal indicative of the change of the set output value. The control portion 15 monitors the current inputted to the inverter circuit 8 through the output signals from the input-current detection portion 9, and the control portion 15 drives and controls the switching device 11 such that the heating output from the inverter circuit 8 (the infrared-ray detection signal A) comes to be equal to the set output value. Since the switching device 11 is thus driven and controlled, a high-frequency current corresponding to the set output value is supplied to the heating coil 3.

Figure 2:
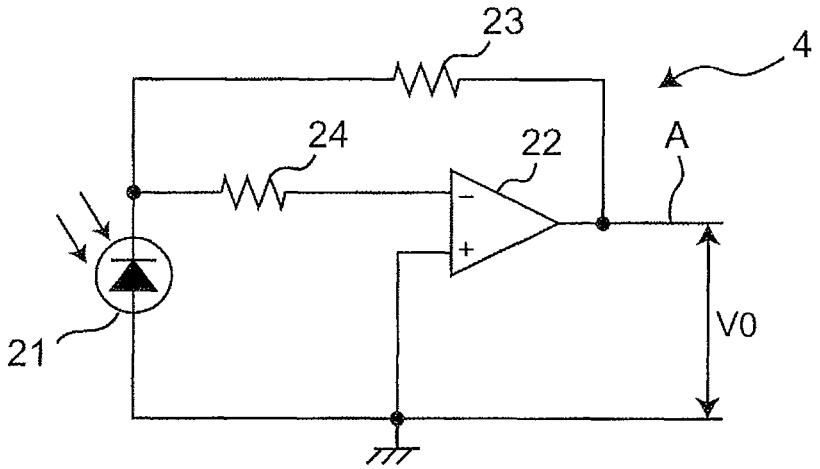
FIG. 2 is a circuit diagram illustrating the schematic structure of an infrared sensor used in the induction heating cooker according to the first embodiment.

FIG. 2 is a circuit diagram schematically illustrating the structure of the infrared sensor as the cooking-container temperature detector used in the induction heating cooker according to the first embodiment. As illustrated in FIG. 2, the infrared sensor 4 is structured to include a photo diode 21, an operational amplifier 22, and two resistances 23 and 24. The resistances 23 and 24 are connected, at their respective one ends, to a cathode of the photo diode 21. The resistance 23 is connected, at its other end, to the output terminal of the operational amplifier 22, while the resistance 24 is connected, at its other end, to the inverting-output terminal (−) of the operational amplifier 22. The photo diode 21 is a photoreceptor device made of InGaAs and the like through which an electric current flows by being irradiated with infrared rays with wavelengths of 3 micrometers or less having passed through the top plate 1 from the cooking container 2, wherein the amplitude of the electric current flowing therethrough and the rate of the increase thereof are increased with increasing amount of energy of incident infrared rays. The electric current induced by the photo diode 21 is amplified by the operational amplifier 22, and the amplified electric current is outputted to the control portion 15, as an infrared-ray detection signal A (corresponding to a voltage value V0) indicative of the temperature of the cooking container 2. The infrared sensor 4 used in the induction heating cooker according to the first embodiment is structured to receive infrared rays radiated from the cooking container 2, and therefore, has excellent thermal responsiveness with respect to the change of the temperature of the bottom surface of the cooking container 2, in comparison with a thermistor adapted to detect the temperature through the top plate 1, which enables accurate control of the temperature of the bottom surface of the cooking container 2.

Figure 3:
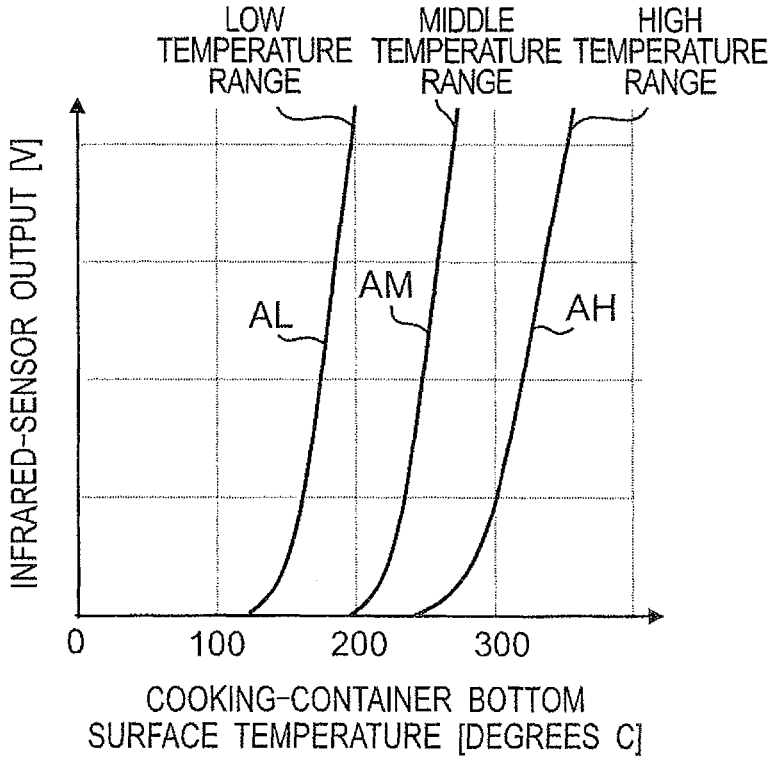
FIG. 3 is a graph illustrating output characteristics of the infrared sensor in the induction heating cooker according to the first embodiment.

FIG. 3 is a graph illustrating output characteristics of the infrared sensor 4. Referring to FIG. 3, the horizontal axis represents the temperature of the bottom surface of the cooking container 2 such as a pan (the temperature of the pan bottom), while the vertical axis represents the voltage value (V0) of the infrared-ray detection signal A outputted from the infrared sensor 4. When infrared rays with wavelengths of 3 micrometers or less having passed through the top plate 1 enter the photo diode 21 in the infrared sensor 4, an electric current flows through the photo diode 21. For example, in defining a low-temperature range as being equal to or higher than 120 degrees C. but lower than 200 degrees C., defining a middle-temperature range as being equal to or higher than 200 degrees C. but lower than 250 degrees C., and defining a high-temperature range as being equal to or higher than 250 degrees C. but lower than 330 degrees C., for the temperature of the bottom surface of the cooking container 2, the infrared sensor 4 is adapted to change over its amplification rate determined by the resistance 23 and the resistance 24, in such a way as to decrease the amplification rate as the temperature shifts to higher temperature ranges in the order of the low-temperature range, the middle-temperature range and the high-temperature range, along with the transition of the temperature of the bottom surface of the cooking container 2 from the low-temperature range to the high-temperature range, namely along with the increase of the amount of energy of incident infrared rays (the detected value).

In the induction heating cooker according to the first embodiment, the infrared sensor 4 is adapted such that its the amplification rate is changed over, in such a way as to output an infrared-ray detection signal AL when the temperature of the bottom surface of the cooking container 2 is equal to or higher than about 120 degrees C. but lower than 200 degrees C., to output an infrared-ray detection signal AM when the temperature of the bottom surface is equal to or higher than about 200 degrees C. but lower than 250 degrees C., and to output an infrared-ray detection signal AH when the temperature of the bottom surface is equal to or higher than about 250 degrees C. but lower than 330 degrees C. Further, the infrared sensor 4 is structured such that it does not output an infrared-ray detection signal A, when the temperature of the bottom surface of the cooking container 2 is lower than about 120 degrees C. In this case, the term "it does not output an infrared-ray detection signal A" includes states where the infrared sensor 4 outputs no infrared-ray detection signal A at all, and also includes states where it outputs substantially no infrared-ray detection signal A, such as states where it outputs only a slight infrared-ray detection signal A. Namely, the term "it does not output an infrared-ray detection signal A" includes states where it outputs a faint signal enough to prevent the control portion 15 from substantially reading the temperature change in the bottom surface of the cooking container 2 based on the change of the amplitude of the infrared-ray detection signals A. As illustrated in the graph in FIG. 3, when the temperature of the cooking container 2 comes to be equal to or higher than about 120 degrees C., the output value of the infrared-ray detection signal A increases along a power function ($V=aT^b$: "V" is the output voltage, "T" is the pan temperature, "a" and "b" are positive real numbers, b is 5 to 10, for example).

Note that the temperature sensor in the infrared sensor 4 is not limited to a photo diode, and also includes thermopiles and other temperature sensors.

Figure 4:
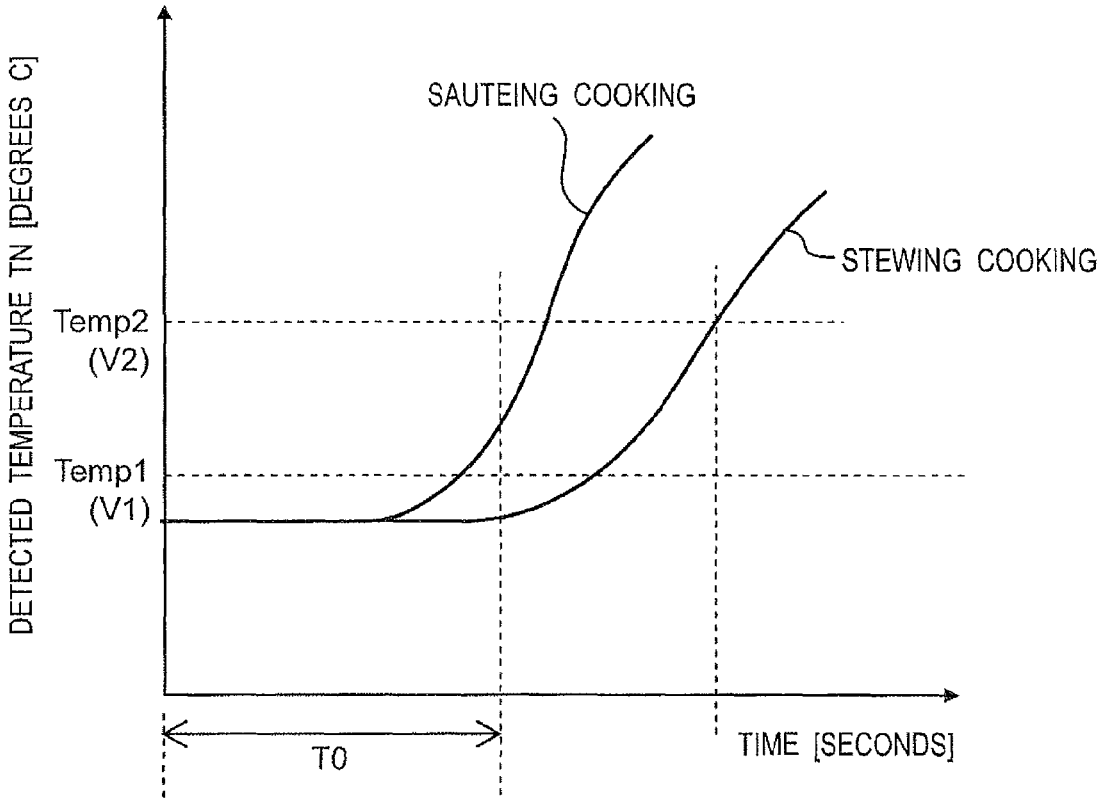
FIG. 4 is a view illustrating the relationship between the elapsed time period and the temperature detected by the infrared sensor, after start of heating with the induction heating cooker according to the first embodiment.
Figure 5:
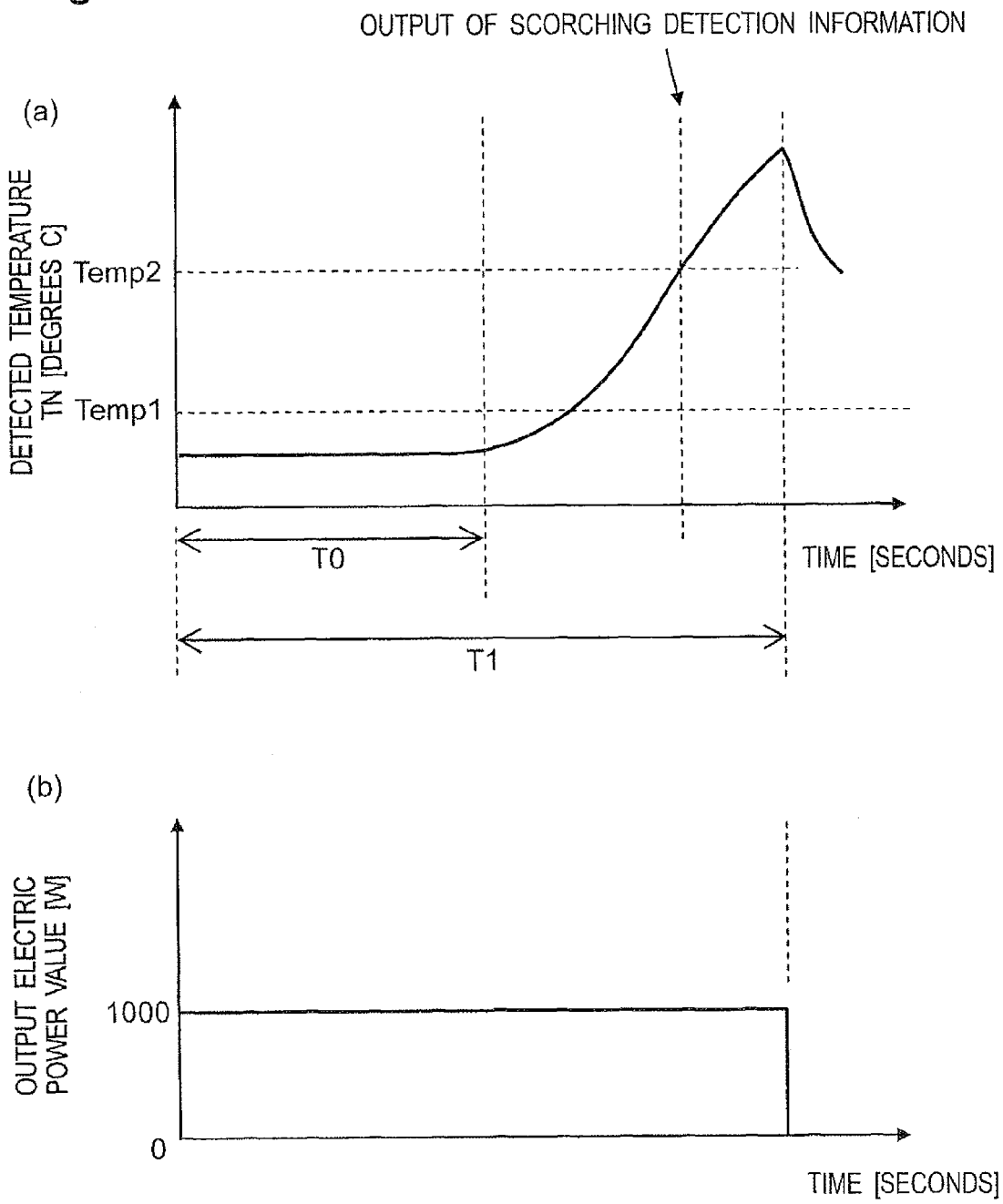
FIG. 5 is a view illustrating the relationship between the elapsed time period and the temperature detected by the infrared sensor, and the relationship between the elapsed time period and the output electric-power value W, after start of heating with the induction heating cooker according to the first embodiment.

Next, with reference to FIG. 4 and FIG. 5, the structure of the scorching detection portion 50 and scorching detection operations will be described, in the induction heating cooker according to the first embodiment. FIG. 4 is a view exemplarily illustrating the detected temperature Tn in the detected-temperature calculation portion 30, for describing a method of determining whether the current cooking is stewing cooking or cooking involving rise to a higher temperature in a shorter time period (such as sauteing cooking). FIG. 4 illustrates an example of the relationship between the elapsed time period and the temperature Tn detected by the infrared sensor 4 after start of heating. FIG. 5(*a*) is a graph illustrating an example of the relationship between the elapsed time period [seconds] and the temperature Tn [degrees C.] detected by the infrared sensor 4 after the start of heating, and FIG. 5(*b*) is a graph illustrating an example of the relationship between the elapsed time period [seconds] and the output electric-power value [W].

Hereinafter, for ease of description, it is assumed that the output setting is not changed from [Setting 4: 1000 W], and the actual output electric-power value [W] is also 1000 W. The infrared-ray detection signal A as infrared-ray detection information indicative of the temperature of the cooking container 2, which is outputted from the infrared sensor 4, namely the output voltage [V0] from the infrared sensor 4, is inputted to the control portion 15. Further, the control portion 15 determines the amplitude of the output voltage [V0], converts the result of the determination into the temperature indicated by the infrared-ray detection information with the detected-temperature calculation portion 30, and sends it to the scorching detection portion 50. Note that the infrared-ray detection signal A from the infrared sensor 4 can be directly inputted to the scorching detection portion 50, without interposition of the control portion 15. In this case, the scorching detection portion 50 includes a temperature storage portion (not illustrated) for preliminarily storing a first output-voltage value V1, and a second output-voltage value V2 which is a value larger than the first output-voltage value 1 (V2>V1).

Referring to FIG. 4, the value of the detected temperature Tn expressed in Celsius degrees is the value of the temperature which has been resulted from the conversion of the infrared-ray detection information outputted from the infrared sensor 4 by the detected-temperature calculation portion 30, thereby indicating the temperature indicated by the infrared-ray detection information. For example, the value of the detected temperature Tn of the cooking container 2 which is equal to "Temp 1 (a first set temperature)" [degrees C.] indicates the temperature (for example, about 130 degrees C.) indicated by the infrared-ray detection information when the first output-voltage value V1 is outputted from the infrared sensor 4.

Similarly, the value of the detected temperature Tn of the cooking container 2 which is equal to "Temp 2 (a second set temperature)" [degrees C.] indicates the temperature (for example, about 240 degrees C.) indicated by the infrared-ray detection information when the second output-voltage value V2 is outputted from the infrared sensor 4. Hereinafter, the output voltage from the infrared sensor 4 will be expressed as the detected temperature Tn from the infrared sensor 4 in Celsius degrees, by being converted into the temperature.

Referring to FIG. 4, when the temperature of the bottom surface of the cooking container 2 being heated at Setting 4 (1000 W) is raised, the temperature detected by the infrared sensor 4 starts rising. Further, at first, the control portion 15 determines whether the current cooking is stewing cooking that necessitates the scorching detection function or cooking that necessitates no scorching detection function (for example, sauteing cooking), based on the detected temperature Tn of when the measured cooking time period Tp after the start of heating, which has been measured by the first time-measurement portion 31, has reached a predetermined initial set elapsed time period T0. In cases of stewing cooking, which involves a larger amount of water in comparison with sauteing cooking, for example, the temperature of the object to be cooked in the cooking container 2 is ordinarily changed around 100 degrees C., and when the water has been vaporized to be run out, thereby causing the object to be cooked to start scorching, the temperature of the cooking container 2 also starts rising. On the other hand, in cases of sauteing cooking, in general, if the heating is continued, the temperature is continuously raised, in many cases. Based on this difference, the determination is performed as to whether the object to be cooked is an object with a higher water content or an object with a lower water content. The control portion 15 determines that the current cooking is cooking involving a smaller amount of water, such as sauteing cooking, other than stewing cooking, in the case where the detected temperature Tn of when the measured cooking time period Tp has reached the initial set elapsed time period T0 is higher than the first set temperature Temp 1 [degrees C.]. On the other hand, in the case where the detected temperature Tn at this time is equal to or lower than the first set temperature Temp 1 [degrees C.], the control portion 15 determines that the current cooking is stewing cooking. Note that, instead of determining whether the current cooking is stewing cooking which necessitates the scorching detection function or cooking which necessitates no scorching detection function (for example, sauteing cooking) based on whether the detected temperature Tn is higher or lower when the measured cooking time period Tp after the start of heating, which has been measured by the first time-measurement portion 31, has reached a predetermined time period, such as the initial set elapsed time period T0, as described above, it is also possible to determine whether the current cooking is stewing cooking which necessitates the scorching detection function or cooking which necessitates no scorching detection function (for example, sauteing cooking), based on, whether the measured cooking time period Tp until the detected temperature Tn has reached a predetermined temperature is longer or shorter. For example, it is also possible to determine that the current cooking is stewing cooking, in the case where the measured cooking time period Tp until the first set temperature Temp 1 [degrees C.] has been reached is equal to or longer than the initial set elapsed time period T0. On the other hand, in the case where the measured cooking time period Tp is shorter than the initial set elapsed time period T0, it is possible to determine that the current cooking is cooking which necessitates no scorching detection function, other than stewing cooking.

Next, as illustrated in FIG. 5, after determining that the current cooking is stewing cooking since the detected temperature Tn of when the measured cooking time period Tp after the start of the heating has reached the initial set elapsed time period T0 is equal to or lower than the first set temperature Temp 1, if the heating is continued, the water in the object to be cooked is gradually reduced. At last, the water in the object to be cooked is run out, thereby starting scorching. Along with the progress of the scorching, the detected temperature Tn starts rising. Therefore, when the detected temperature Tn reaches the second set temperature Temp 2 [degrees C.], the scorching detection portion 50 determines that scorching has occurred, and outputs a scorching detection signal B.

In cases of stewing cooking, it is desirable that, at this time, the control portion 15 drives and controls the inverter circuit 8 to stop the operation for heating the cooking container 2 through the heating coil 3. However, in cases of sauteing cooking, if the scorching detection portion 50 detects scorching, the heating is stopped or the heating output is reduced halfway through the cooking, in order to prevent progress of the scorching.

Therefore, in the induction heating cooker according to the first embodiment, even if the scorching detection portion 50 outputs a scorching detection signal B, there is a non-zero possibility that it is sauteing cooking. Therefore, as illustrated in FIG. 5(B), even if the scorching detection portion 50 outputs a scorching detection signal B, when the measured cooking time period Tp after the start of heating has not reached the first set elapsed time period T1, the control portion 15 determines that it is sauteing cooking, and continues the heating operation. Further, after the measured cooking time period Tp after the start of heating has reached the first set elapsed time period T1, in the case where the detected temperature Tn is equal to or higher than the second set temperature Temp 2, the control portion 15 confirms scorching detection, and performs a heating-output suppression operation for stopping the operation for controlling the inverter circuit 8 for stopping the heating operation on the cooking container 2 or for suppressing the heating output for preventing the progress of the scorching. Note that the term "confirms scorching detection" means performing a heating-output suppression operation based on the scorching detection information (the same will apply in the following description). In the case where the induction heating cooker is provided with a display portion or a notification portion, when the occurrence of scorching is confirmed, it is possible to give an indication of the stop of heating operations as a notification for informing the user thereof.

The induction heating cooker according to the first embodiment is adapted to continue heating operations until the elapse of the first set elapsed time period T1, namely adapted to substantially determine that the current cooking is sauteing until the elapse of the first set elapsed time period T1, for the following reason. In general, stewing cooking takes a longer time period, while other cooking (such as sauteing cooking) can be completed in a shorter time period, in comparison with stewing cooking. Therefore, by continuing heating operations, it is possible to reduce the possibility of stopping of heating operations before the completion of cooking, in such a way as to prevent sauteing cooking and the like from being wrongly determined to be stewing cooking.

As can be seen from the facts described, by making the first set elapsed time period T1 longer, it is possible to prevent heating operations from being stopped before the completion of cooking, more largely, during cooking other than stewing cooking. However, if it is set to be an excessively-longer time period, this induces the problem of progress of scorching, when scorching has actually occurred during stewing cooking. Therefore, the first set elapsed time period T1 is desirably set to be a shortest possible time period which is longer than time periods estimated to be generally required for completion of cooking.

From the facts stated above, in the induction heating cooker according to the first embodiment, the scorning detection portion 50 in the control portion 15 outputs scorching detection information (a scorching detection signal B), in the case where the detected temperature Tn reaches the second set temperature Temp2 during stewing cooking. Further, when the measured cooking time period Tp measured by the first time-measurement portion 31 has not reached the first set elapsed time period T1, the scorching detection information (the scorching detection signal B) exerts no effect on the heating output. Further, in the case where scorching detection information is outputted, and also the measured cooking time period Tp measured by the first time-measurement portion 31 has come to be equal to or longer than the first set elapsed time period T1, the heating of the cooking container 2 through the heating coil 3 is stopped. Accordingly, until the elapse of the first set elapsed time period T1, during sauteing cooking, it is possible to prevent sauteing cooking from being wrongly determined to be stewing cooking, thereby enabling continuing the heating until the completion of cooking.

Further, as described above (see FIG. 4), in a phase where the temperature of the cooking container 2 has not reached a temperature which induces scorching, the control portion 15 determines whether the current cooking is stewing cooking or other cooking (such as sauteing cooking), wherein stewing cooking necessitates detecting scorching of the pan or the like and performing heating-output suppression operations for preventing progress of the scorching, while the other cooking less necessitates detecting scorching and performing heating-output suppression operations. Further, the control portion 15 confirms scorching detection only when determines that the current cooking is stewing cooking. Therefore, even when the measured cooking time period Tp measured by the first time-measurement portion 31 comes to be equal to or longer than the first set elapsed time period T1, it is possible to continue sauteing cooking with excellent accurately. In the case where such an effect is not expected, it is also possible to eliminate the function of determining whether it is stewing cooking or sauteing cooking, in a phase where the temperature of the cooking container 2 has not reached a temperature which induces scorching. Note that, in cases of providing the function of determining whether the current cooking is stewing cooking or sauteing cooking, in a phase where the temperature of the cooking container 2 has not reached a temperature which induces scorching, it may be difficult to make the determination as to whether it is stewing cooking or sauteing cooking, in some cases, since the object to be cooked may discharge water during the cooking, which may inhibit temperature rises even when the heating is continued, depending on the type and the amount of the object to be cooked. However, even in such cases, it is possible to perform sauteing cooking for at least the first set elapsed time period T1.

It is to be note that the induction heating cooker according to the first embodiment has been described as being structured to determine whether the current cooking is stewing cooking which necessitates the scorching detection function or cooking which necessitates no scorching detection function (such as sauteing cooking), based on the detected temperature Tn of when the measured cooking time period Tp after the start of heating, which has been measured by the first time-measurement portion 31, has reached the predetermined initial set elapsed time period T0. However, the present invention is not limited to this determination method, and also can employ a method which makes such a determination based on the state of the change of the detected temperature Tn after the start of heating, for example. In short, if the rise of the detected temperature Tn measured before the detected temperature Tn has reached the second set temperature Temp 2 [degrees C.] is less than a predetermined value, it is possible to determine the current cooking is stewing cooking. On the other hand, if it is equal to or more than the predetermined value, it is possible to determine the current cooking is sauteing cooking.

While the induction heating cooker according to the first embodiment has been described as being structured to convert the output voltage from the infrared sensor 4 into the temperature with the detected-temperature calculation portion 30, the present invention is not limited to this structure, and also can employ a structure for performing control directly based on the output voltage from the infrared sensor 4, which can also offer the same effects.

The induction heating cooker according to the first embodiment has been described with respect to cases where the set output value is Setting 4 (1000 W), the same control is performed in cases of other set values. Further, by setting the initial set elapsed time period T0, the first set elapsed time period T1, the first set temperature Temp 1 and the second set temperature Temp 2 as threshold values of the detected temperature Tn from the infrared sensor 4 to be respective optimum values, for each set output value, it is possible to perform control with higher accuracy.

Further, depending on the type of the metal material forming the cooking container 2, which can be determined from information from the inverter circuit 8 (for example, information about ON time periods of the switching device 11, the electric current flowing through the heating coil 3, the frequency at which the switching device 11 is controlled, the electric current supplied to the inverter circuit 8, and the like), it is possible to set the initial set elapsed time period T0, the first set elapsed time period T1, the first set temperature Temp 1 and the second set temperature Temp 2 as threshold values of the detected temperature Tn from the infrared sensor to be respective optimum values, which enables determinations with higher accuracy. This is because various characteristics of the cooking container 2, such as the thermal conductivity, are varied depending on the type of the metal material, as well as depending on the size of the cooking container 2, and such variations in the thermal conductivity and the like induce variations in degree of progress of scorching.

Further, the induction heating cooker according to the first embodiment is adapted to impose no limit on the set output value. However, intrinsically, with increasing heating power, it becomes harder to make the determination as to whether the current cooking is strewing cooking or other cooking than stewing (for example, sauteing cooking) only from the detected temperature form the infrared sensor 4. Therefore, it is desirable to exert the scorching detection function for stewing cooking, only when the set output value is equal to or lower than a predetermined value. A method for attaining this can be realized by causing the control portion 15 to perform control in such a way as not to exert the scorching detection function, when the value having been set through the output setting portion 14*b* in the manipulation portion 14 is greater than a predetermined value.

Further, while the induction heating cooker according to the first embodiment has been described as being structured to stop heating operations when scorching detection has been confirmed, the present invention is not limited to such a structure. The induction heating cooker can have any structure capable of suppressing progress of scorching, when scorching detection has been confirmed. For example, the induction heating cooker can be also structured to continue heating operations with an output corresponding to heating power of about 100 W to 200 W, which is required for so-called heat retention, when scorching detection has been confirmed.

Further, the induction heating cooker according to the first embodiment is adapted to detect the temperature of the bottom surface of the cooking container 2 with the infrared sensor 4, and is thus capable of detecting the temperature of the bottom surface with excellent responsivity, in comparison with cases of using thermo-sensitive devices such as thermistors. As a result, the induction heating cooker according to the first embodiment has a structure capable of detecting scorching with higher accuracy.

Second Embodiment

Next, an induction heating cooker according to a second embodiment of the present invention will be described, with reference to FIGS. 1 to 4 and FIG. 6 as stated above. Note that components having the same functions and structures as those described with respect to the induction heating cooker according to the first embodiment will be designated by the same reference characters and will not be described.

Figure 6:
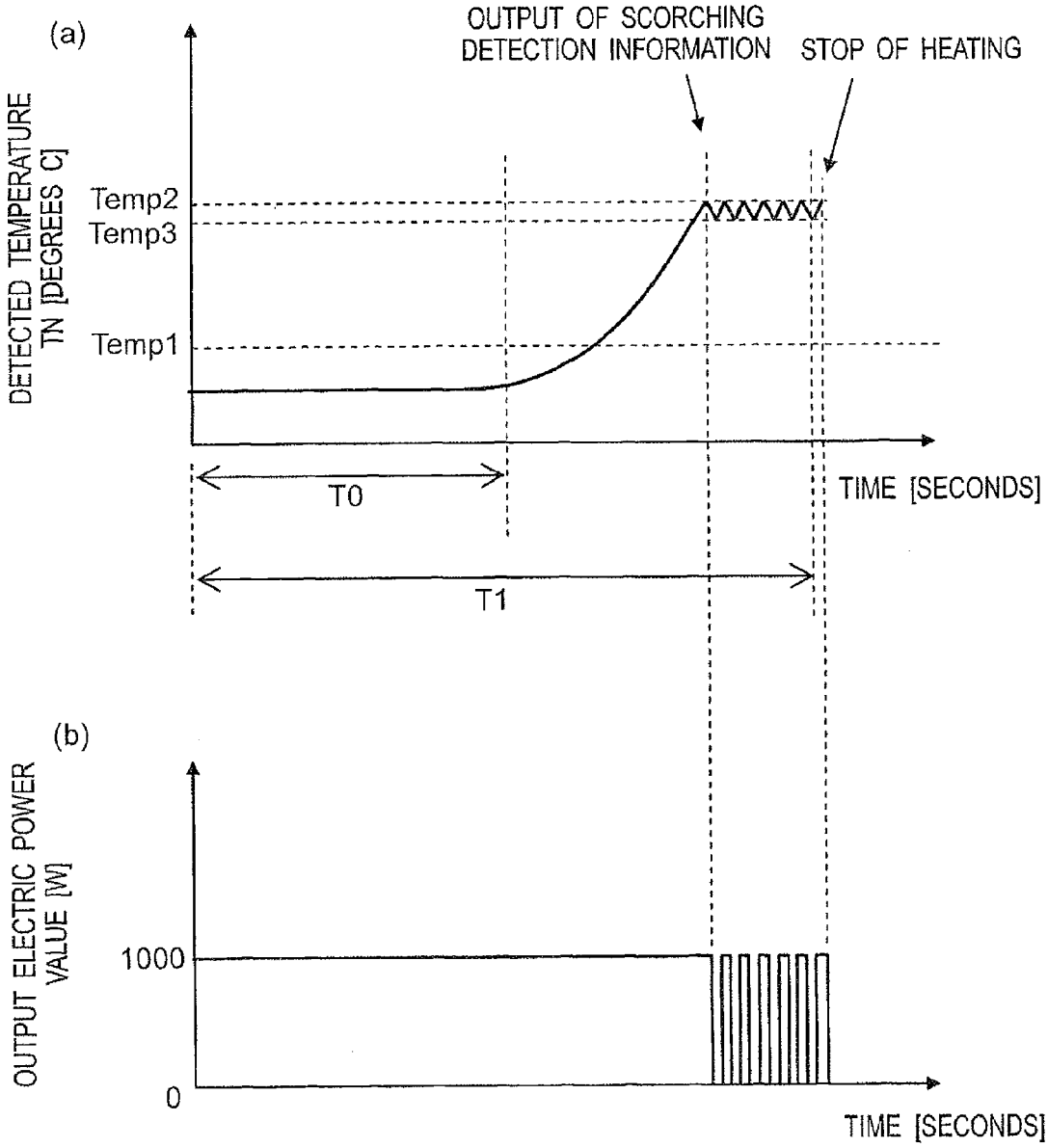
FIG. 6 is a view illustrating the relationship between the elapsed time period and the temperature detected by the infrared sensor, and the relationship between the elapsed time period and the output electric-power value, after start of heating with an induction heating cooker according to a second embodiment.

FIG. 6 is a graph (FIG. 6(*a*)) illustrating an example of the relationship between the elapsed time period [seconds] and the temperature Tn [degrees C.] detected by an infrared sensor 4 after the start of heating, and a graph (FIG. 6(*b*)) illustrating an example of the relationship between the elapsed time period [seconds] and the output electric-power value [W], in the induction heating cooker according to the second embodiment of the present invention.

Referring to FIG. 6, when the detected temperature Tn reaches a second set temperature Temp 2, a scorching detection portion 50 outputs a scorching detection signal B. However, since the measured cooking time period Tp after the start of heating has not reached a first set elapsed time period T1, the operation for controlling an inverter circuit 8 by a control portion 15 is not stopped. However, if the heating is continued with the same output electric-power value (1000 W in the second embodiment), the temperature of the cooking container 2 continues rising and, when scorching has occurred during stewing cooking, the scorching is continuously progressed and advanced to higher degrees.

In order to avoid such situations, in the induction heating cooker according to the second embodiment, when the detected temperature Tn reaches the second set temperature Temp 2, the heating operation on the cooking container 2 is temporality brought into an OFF state. When, as a result, the detected temperature Tn is lowered to reach a third set temperature Temp 3 (in the second embodiment, the third set temperature Temp 3 has a value lower by 5 degrees C. than the second set temperature Temp 2), which is equal to or lower than the second set temperature Temp 2 the heating operation is brought into an ON state, again. Namely, ON and OFF states are intermittently repeated for performing temperature control, in such a way as to prevent the detected temperature Tn from exceeding the second set temperature Temp 2. Further, when the measured cooking time period Tp after the start of heating has reached the first set elapsed time period T1, and also the detected temperature Tn reaches the second set temperature Temp 2, the occurrence of scorching during stewing cooking is confirmed, and the operation for controlling the inverter circuit 8 by the control portion 15 is stopped for continuously stopping the heating operation on the cooking container 2. Note that the temperature defined by the second set temperature Temp 2 may be equal to the temperature defined by the third set temperature Temp 3.

As described above, in the induction heating cooker according to the second embodiment, when the detected temperature Tn reaches the second set temperature Temp 2, in the case where the measured cooking time period Tp measured by the first time-measurement portion 31 is less than the first set elapsed time period T1, the scorching detection portion 50 in the control portion 15 outputs scorching detection information (a scorching detection signal B), while the temperature control is performed in such a way as to prevent the second set temperature Temp 2 from being exceeded. Further, the induction heating cooker according to the second embodiment is structured to perform an operation for suppressing the heating output to the cooking container 2 through the heating coil 3 (for example, stopping the heating operation), when the measured cooking time period Tp measured by the first time-measurement portion 31 comes to be equal to or more than the first set elapsed time period T1. Further, since the induction heating cooker according to the second embodiment is structured as described above, the induction heating cooker is capable of continuing heating until the completion of cooking even if scorching detection information is outputted during sauteing cooking, and also the induction heating cooker is capable of suppressing progress of the scorching during stewing cooking.

Further, the control portion 15 can determine whether the current cooking is stewing cooking or other cooking (for example, sauteing cooking), and also can perform operations for suppressing the heating output to the cooking container 2 through the heating coil 3 only during stewing cooking, even when the detected temperature Tn has reached the second set temperature Temp 2 and also the measured cooking time period Tp measured by the first time-measurement portion 31 is equal to or longer than the first set elapsed time period T1. This can increase the heating time for sauteing cooking. In the case where this effect is not expected, it is also possible to eliminate the function of determining whether it is stewing cooking or sauteing cooking, in a phase where the temperature of the cooking container 2 has not reached a temperature which induces scorching.

Note that the induction heating cooker according to the second embodiment is adapted to output scorching detection information and perform temperature control operations, if the detected temperature Tn reaches the second set temperature Temp 2, before the measured cooking time period Tp reaches the first set elapsed time period T1. However, the induction heating cooker may also perform an operation for confirming scorching detection (for example, an operation for indicating occurrence of scorching) at the time when the measured cooking time period Tp has reached the first set elapsed time period T1, for example, since the temperature control has been already performed since the detected temperature Tn reached the second set temperature Temp 2.

Further, the induction heating cooker according to the second embodiment is adapted to perform temperature control in such a way as to prevent the second set temperature Temp 2 from being exceeded, until the measured cooking time period Tp after the start of heating reaches the first set elapsed time period T1, after the detected temperature Tn has reached the second set temperature Temp 2. However, the present invention is not limited to this structure, and can employ any structure capable of alleviating the degree of progress of scorching. For example, it is also possible to employ a structure for performing control for varying the output for heating operations according to the gradients of temperature changes in the detected temperature Tn and the absolute values thereof for making the temperature substantially constant (for example, fussy control), which can also offer the same effects. Further, while there has been described a structure for performing temperature control through ON and OFF control during heating operations, it is also possible to perform temperature control by varying the heating output, instead of bringing heating operations into OFF states, for example.

Third Embodiment

Next, an induction heating cooker according to a third embodiment of the present invention will be described, with reference to FIGS. 1 to 4 and FIGS. 7 and 8 as described. Further, components having the same functions and structures as those described with respect to the induction heating cookers according to the first and second embodiments will be designated by the same reference characters and will not be described.

Figure 7:
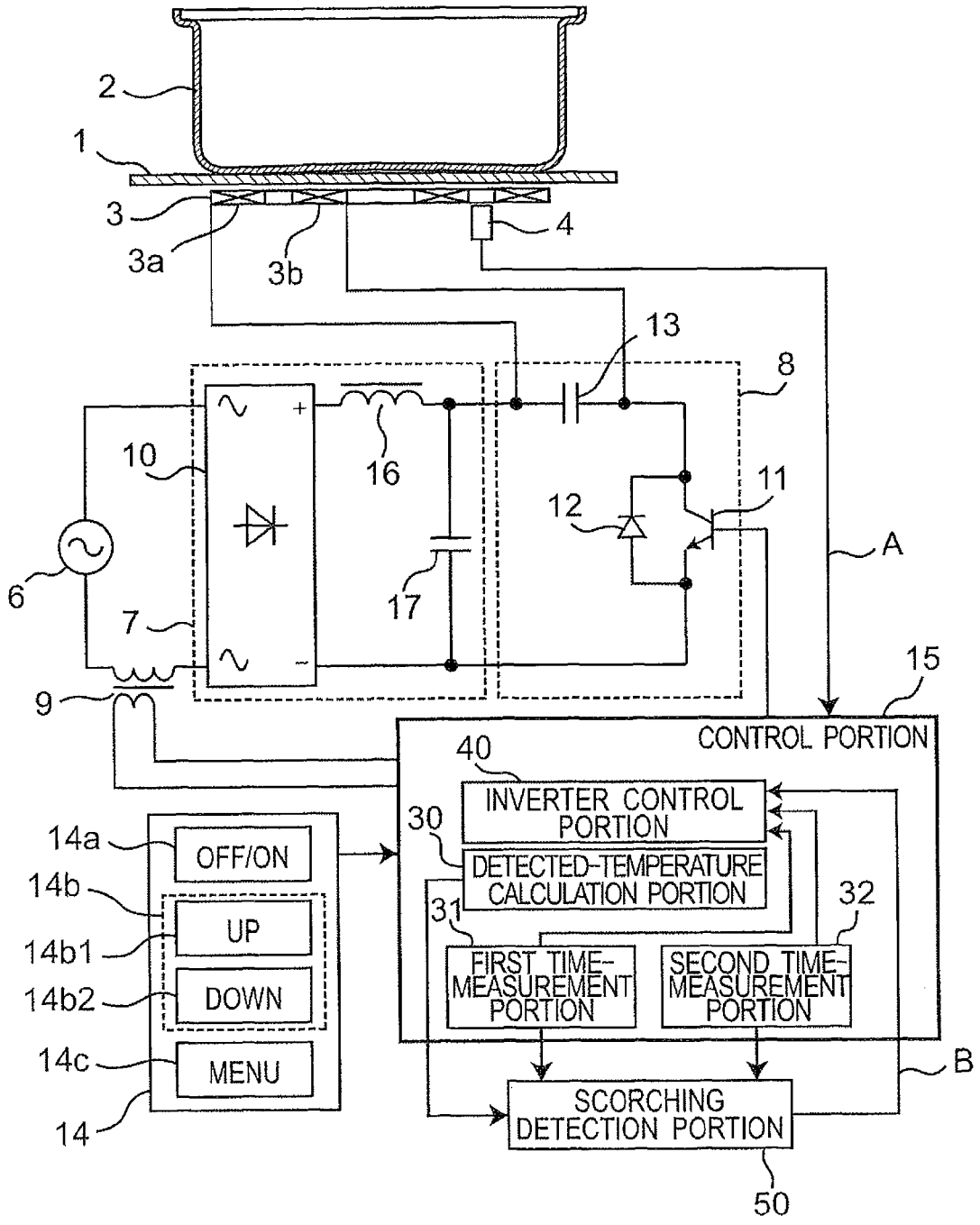
FIG. 7 is a block diagram illustrating the entire structure of an induction heating cooker according to a third embodiment of the present invention.

FIG. 7 is a block diagram illustrating the entire structure of the induction heating cooker according to the third embodiment of the present invention. As illustrated in FIG. 7, in the induction heating cooker according to the third embodiment, a control portion 15 is provided with a second time-measurement portion 32, and this second time-measurement portion 32 is adapted to measure the elapsed time period after a detected temperature Tn has reached a second set temperature Temp 2.

Figure 8:
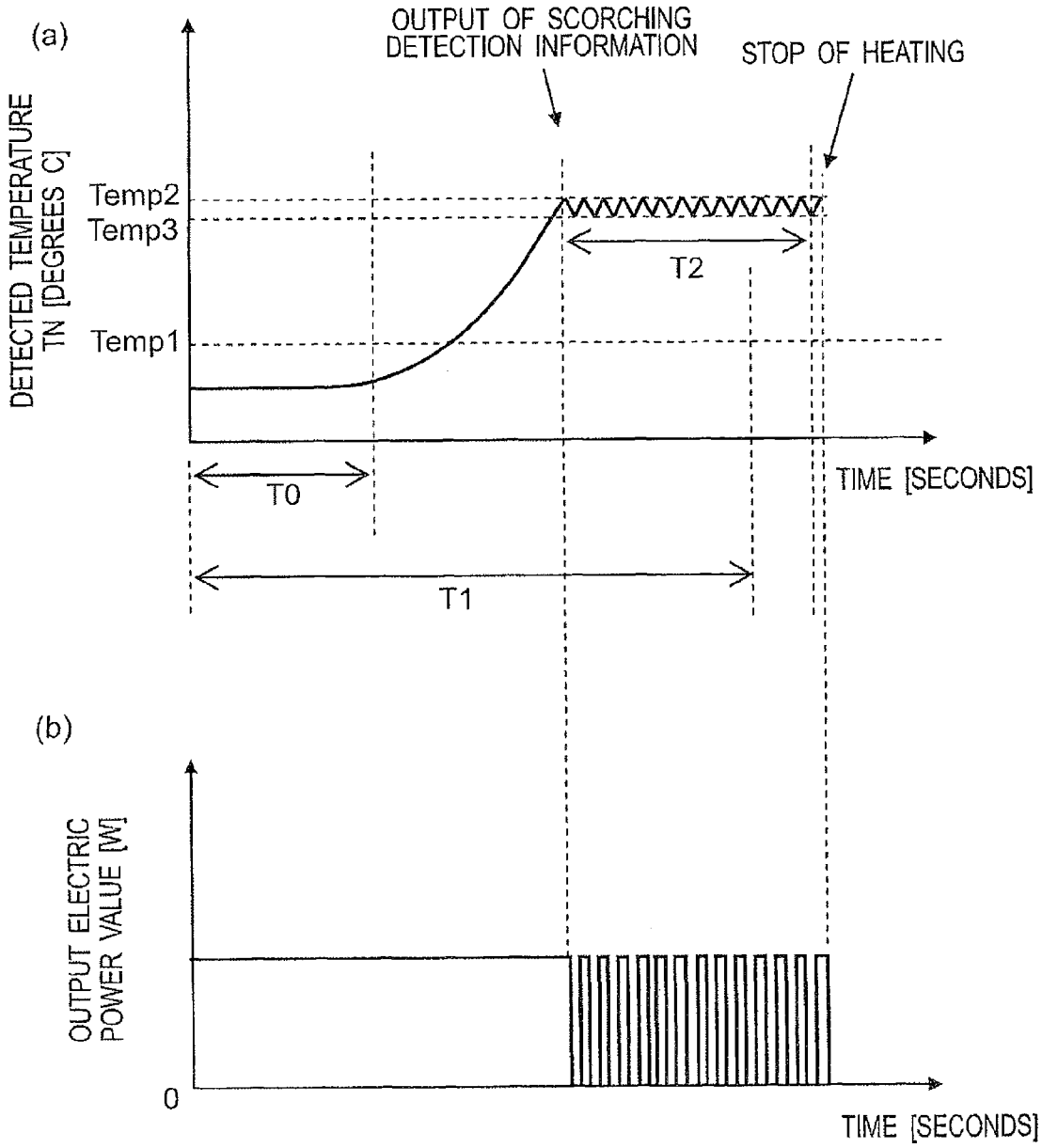
FIG. 8 is a view illustrating the relationship between the elapsed time period and the temperature detected by an infrared sensor, and the relationship between the elapsed time period and the output electric-power value, after start of heating with an induction heating cooker according to a third embodiment.
Figure 9:
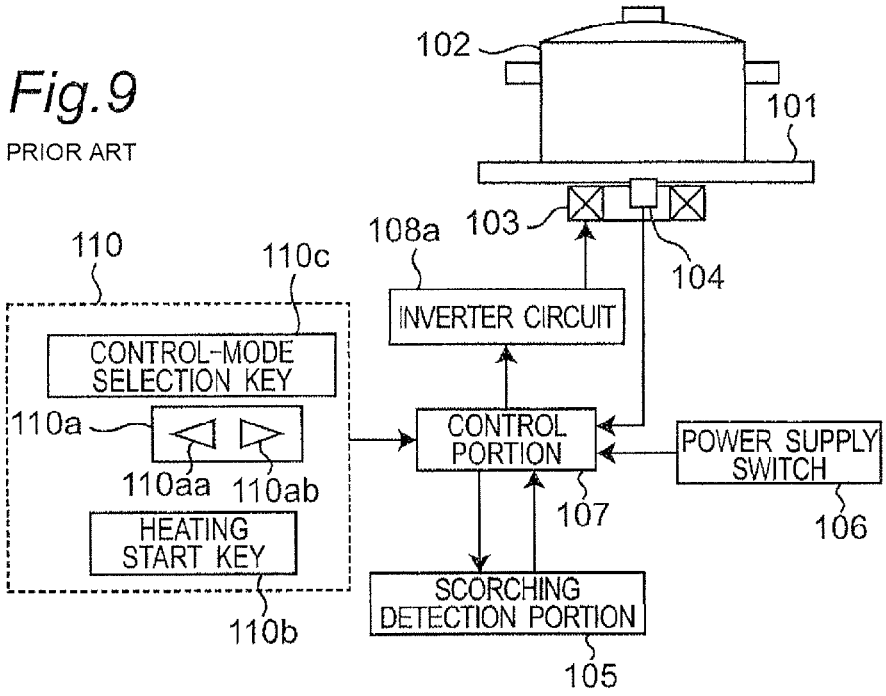
Fig.9 PRIOR ART
FIG. 9 is the block diagram illustrating the structure of the conventional induction heating cooker.
Figure 10:
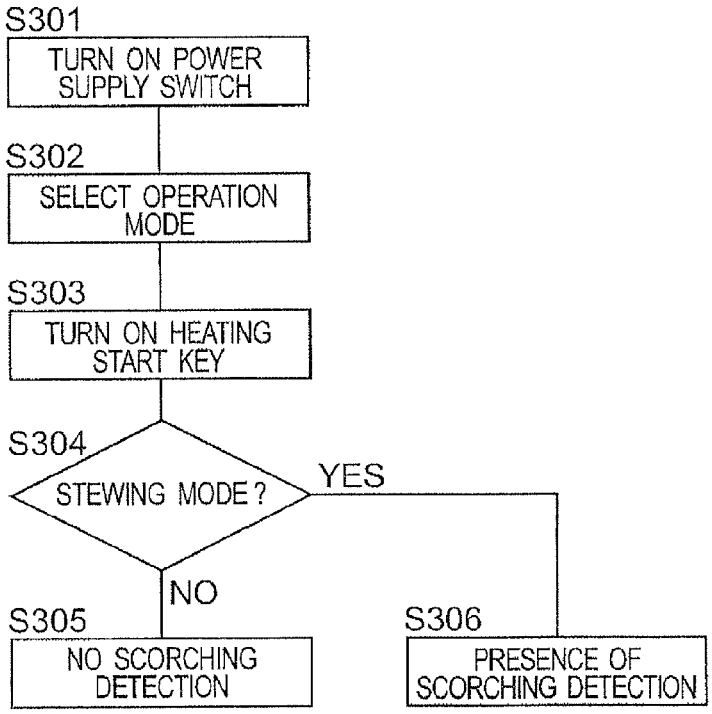
Fig.10 PRIOR ART
FIG. 10 is the flow chart illustrating operations of the conventional induction heating cooker.

FIG. 8 is a graph (FIG. 8(*a*)) illustrating an example of the relationship between the elapsed time period [seconds] and the temperature Tn [degrees C.] detected by an infrared sensor 4 after the start of heating, and a graph (FIG. 8(*b*)) illustrating an example of the relationship between the elapsed time period [seconds] and the output electric-power value [W], in the induction heating cooker according to the third embodiment.

Referring to the graph in FIG. 8(*a*), even after the elapse of an initial set elapsed time period T0 since the start of heating, the detected temperature Tn from the infrared sensor 4 is equal to or lower than a first set temperature Temp 1, and therefore, the scorching detection portion 50 determines that the current cooking is stewing cooking, at this time. Then, the heating operation is continued, and water in the object to be cooked in a cooking container 2 is vaporized. Thereafter, the object to be cooked starts gradually scorching. Further, when the detected temperature Tn reaches the second set temperature Temp 2, the scorching detection portion 50 outputs scorching detection information (a scorching detection signal B), and the second time-measurement portion 32 in the control portion 15 starts measuring the elapsed time period. The elapsed time period measured at this time is referred to as a measured cooking-continuing time period Tq. Further, the control portion 15 performs temperature control, such that the temperature indicated by the infrared-ray detection information comes to be a temperature between the second set temperature Temp 2 and a third set value Temp 3 which is equal to or lower than the second set value Temp 2, namely such that the detected temperature Tn does not exceed the second set temperature Temp 2. Note that the temperature defined by the second set temperature Temp 2 may be equal to the temperature defined by the third set temperature Temp 3.

Further, even after the measured cooking time period Tp after the start of heating has reached the first set elapsed time period T1, during a period when the measured cooking-continuing time period Tq after the detected temperature Tn reached the second set temperature Temp 2 has not reached a second set elapsed time period T2, the control portion 15 continues the temperature control. Thereafter, when the detected temperature Tn reaches the second set temperature Temp 2 after the measured cooking-continuing time period Tp has reached the second set elapsed time period T2, scorching detection is confirmed, and the operation for controlling the inverter circuit 8 by the control portion 15 is stopped, thereby continuously stopping the heating operation on the cooking container 2.

Note that the second set elapsed time period T2, which is a predetermined time period, should be set to be shorter than the first set elapsed time period T1 as an elapsed time period after the start of heating, as a matter of course.

In the induction heating cooker having the structure described above according to the third embodiment, the scorching detection portion 50 outputs scorching detection information (a scorching detection signal B), when the detected temperature Tn reaches the second set temperature Temp 2. Further, when the measured cooking time period Tp measured by the first time-measurement portion 31 is less than the first set elapsed time period T1, or when the measured cooking-continuing time period Tq after the detected temperature Tn has reached the second set temperature Temp 2 is less than the second elapsed time period T2, temperature control is performed such that the second set temperature Temp 2 is not exceeded. When the measured cooking time period Tp measured by the first time-measurement portion 31 is equal to or longer than the first set elapsed time period T1, in the case where the measured cooking-continuing time period Tq after the detected temperature Tn has reached the second set temperature Temp 2 comes to be equal to or more than the second elapsed time period T2, an operation for suppressing the heating output to the cooking container 2 through the heating coil 3 is performed (for example, the heating operation is stopped), thereby suppressing the progress of scorching during stewing cooking. Further, since the induction heating cooker according to the third embodiment is structured as described above, it is possible to secure a time period for high-temperature cooking at the second set temperature Temp 2, even in the case where scorching detection information is outputted during sauteing cooking, thereby preventing malfunctions that heating operations are stopped since scorching detection is confirmed before the completion of cooking.

Further, the control portion 15 can determine whether the current cooking is stewing cooking or other cooking (for example, sautering cooking) and, also, can perform operations for suppressing the heating output to the cooking container 2 through the heating coil 3 only during stewing cooking, even when the detected temperature Tn has reached the second set temperature Temp 2, the measured cooking time period Tp measured by the first time-measurement portion 31 is equal to or more than the first set elapsed time period T1 and also the measured cooking-continuing time period Tq after the detected temperature Tn has reached the second set temperature Temp 2 is equal to or more than the second elapsed time period T2. This can increase the heating time for sauteing cooking.

Note that the induction heating cooker according to the third embodiment is structured to confirm scorching detection when both the set time periods out of the first set elapsed time period T1 and the second set elapsed time period T2 have been reached, the present invention is not limited to such a structure. For example, in the present invention, it is also possible to employ a structure adapted to confirm scorching detection when only the second set elapsed time period has been reached, which can also secure a time period for retaining it at a higher temperature, thereby enabling sufficient cooking even in the event that sauteing cooking is wrongly detected as stewing cooking. This can prevent malfunctions that heating operations are stopped before the completion of cooking.

Further, the induction heating cooker according to the third embodiment is structured such that the control portion 15 performs temperature control until the measured cooking-continuing time period Tq in the second time-measurement portion 32 reaches the second elapsed time period T2 after the detected temperature Tn has reached the second set temperature Temp 2, the present invention is not limited to this structure. For example, in the present invention, it is also possible to employ either a structure adapted to continue heating operations with heating power corresponding to the set output value or a structure adapted to continue heating operations with heating power lower than that corresponding to the set output value.

As described above, the induction heating cooker according to the present invention is capable of exerting its scorching detection function in the case where it is estimated that the scorching detection function is required, even during cooking in a heating mode which enables the user to arbitrarily select a heating output through manipulations. Further, the induction heating cooker according to the present invention is capable of inhibiting the scorching detection function, in the case where the scorching detection function may unnecessarily operate to adversely affect cooking operations. Therefore, with the present invention, it is possible to provide an induction heating cooker with excellent usability which is capable of preventing scorching from being progressed to a higher degree, while suppressing adverse influences on normal cooking operations in a heating mode.

INDUSTRIAL APPLICABILITY

The induction heating cooker according to the present invention is capable of detecting scorching, and preventing the scorching from being progressed, in operation modes for performing heating at output setting selected by the user. Further, the induction heating cooker according to the present invention is capable of preventing suppression of the heating output due to unnecessary actuation of scorching detection, during sauteing cooking or other cooking, thereby enabling continuously performing cooking. Therefore, the induction heating cooker according to the present invention can be utilized as those of built-in types, those of desktop types to be used on tables, those of installation-types to be used on placement tables and the like, in wider ranges of domestic and industrial applications.

The invention claimed is:

1. An induction heating cooker comprising:

a top plate supporting a cooking container;

an inverter under the top plate and includes a heating coil for heating the cooking container;

an infrared sensor under the top plate and adapted to output infrared-ray detection information indicative of a temperature of the cooking container, upon detecting an infrared ray radiated from a bottom surface of the cooking container and passed through the top plate;

a scorching detection portion configured to determine whether a current cooking operation is stewing cooking or other cooking and to output scorching detection information indicative of scorching of an object in the cooking container, upon detecting that the temperature indicated by the infrared-ray detection information is equal to or higher than a second set value and where a measured cooking time period Tp until a first set temperature Temp 1 is reached is equal to or longer than an initial set elapsed time period T0;

an output setting portion configured to select a single set output value, out of a plurality of different set output values; and a control portion adapted to control a heating operation by the inverter so as to supply a high-frequency electric current to the heating coil and to make a heating output equal to a set output value selected through the output setting portion, and to perform a heating-output suppression operation for suppressing the heating output or stopping the heating operation by the inverter to prevent scorching, based on the scorching detection information;

wherein the control portion includes a detected-temperature calculation portion adapted to convert the infrared-ray detection information into a temperature, and a first time-measurement portion adapted to measure a cooking time period after start of the heating operation by the inverter, and the control portion performs the heating-output suppression operation based on the scorching detection information, when the measured cooking time period Tp measured by the first time-measurement portion is equal to or more than a first set elapsed time period.

2. The induction heating cooker according to claim 1, wherein the control portion is further adapted to control the heating operation by the inverter such that the temperature indicated by the infrared-ray detection information is a temperature between the second set value and a third set value which is equal to or lower than the second set value, when the scorching detection portion outputs the scorching detection information, and when the measured cooking time period Tp from the first time-measurement portion is equal to or shorter than the first set elapsed time period.

3. The induction heating cooker according to claim 2, wherein the control portion includes the detected-temperature calculation portion adapted to convert the infrared-ray detection information into the temperature, and a second time-measurement portion adapted to measure a cooking-continuing time period after the temperature indicated by the infrared-ray detection information reaches the second set value, and the control portion is adapted to perform the heating-output suppression operation based on the scorching detection information, when the measured cooking time period Tp measured by the first time-measurement portion is equal to or longer than the first set elapsed time period, and also the measured cooking-continuing time period from the second time-measurement portion is equal to or longer than a second set elapsed time period.

4. The induction heating cooker according to claim 1, wherein the control portion further includes a second time-measurement portion adapted to measure a cooking-continuing time period after the temperature indicated by the infrared-ray detection information reaches the second set value, and the control portion is further adapted to perform the heating-output suppression operation based on the scorching detection information, when the measured cooking time period Tp measured by the first time-measurement portion is equal to or longer than the first set elapsed time period, and the measured cooking-continuing time period from the second time-measurement portion is equal to or longer than a second set elapsed time period.

5. The induction heating cooker according to claim 1, wherein the control portion is adapted to perform the heating-output suppression operation based on the scorching detection information, only when the control portion determines that the stewing cooking is being performed, based on the temperature indicated by the infrared-ray detection information.

6. The induction heating cooker according to claim 5, wherein the control portion is adapted to determine that the stewing cooking is being performed, when the temperature indicated by the infrared-ray detection information is equal to or lower than a first set value which is smaller than the second set value, when the measured cooking time period Tp measured by the first time-measurement portion has reached the initial set elapsed time period T0.

7. The induction heating cooker according to claim 5, wherein the control portion is adapted to determine that the stewing cooking is being performed, when the measured cooking time period measured by the first time-measurement portion until the temperature indicated by the infrared-ray detection information has reached a first set value smaller than the second set value is equal to or longer than the initial set elapsed time period T0.

8. An induction heating cooker comprising:

a top plate supporting a cooking container;

an inverter under the top plate and includes a heating coil for heating the cooking container;

an infrared sensor under the top plate and adapted to output infrared-ray detection information indicative of a temperature of the cooking container, upon detecting an infrared ray radiated from a bottom surface of the cooking container and passed through the top plate;

a scorching detection portion configured to determine whether a current cooking operation is stewing cooking or other cooking and to output scorching detection information indicative of scorching of an object in the cooking container, upon detecting that the temperature indicated by the infrared-ray detection information is equal to or higher than a second set value and where a measured cooking time period Tp until a first set temperature Temp 1 is reached is equal to or longer than an initial set elapsed time period T0;

an output setting portion configured to select a single set output value, out of a plurality of different set output values; and a control portion adapted to control a heating operation by the inverter so as to supply a high-frequency electric current to the heating coil and to make a heating output equal to a selected set output value, and further adapted to perform a heating-output suppression operation for suppressing the heating output or stopping the heating operation by the inverter for preventing scorching, based on the scorching detection information;

wherein the control portion includes a detected-temperature calculation portion adapted to convert the infrared-ray detection information into a temperature, and a second time-measurement portion adapted to measure a cooking-continuing time period after the temperature indicated by the infrared-ray detection information reaches the second set value, and the control portion performs the heating-output suppression operation based on the scorching detection information, when the measured cooking-continuing time period measured by the second time-measurement portion is equal to or longer than a second set elapsed time period.

9. The induction heating cooker according to claim 8, wherein the control portion is adapted to control the heating operation by the inverter such that the temperature indicated by the infrared-ray detection information comes to be a temperature between the second set value and a third set value which is equal to or lower than the second set value, when the scorching detection portion has outputted the scorching detection information, and when the measured cooking-continuing time period measured by the second time-measurement portion is equal to or shorter than the second set elapsed time period.

10. The induction heating cooker according to claim 9, wherein the control portion includes the detected-temperature calculation portion adapted to convert the infrared-ray detection information into the temperature, and a first time-measurement portion adapted to measure a cooking time period after start of the heating operation by the inverter, and the control portion is adapted to perform the heating-output suppression operation based on the scorching detection information when the measured cooking time period Tp from the first time-measurement portion is equal to or longer than a first set elapsed time period, and also the measured cooking-continuing time period from the second time-measurement portion is equal to or longer than the second set elapsed time period.

11. The induction heating cooker according to claim 8, wherein the control portion is adapted to perform the heating-output suppression operation based on the scorching detection information, only when the control portion determines that the stewing cooking is being performed, based on the temperature indicated by the infrared-ray detection information.

12. The induction heating cooker according to claim 11, wherein the control portion is adapted to determine that the stewing cooking is being performed, when the temperature indicated by the infrared-ray detection information is equal to or lower than a first set value which is smaller than the second set value, when the measured cooking time period Tp measured by a first time-measurement portion has reached the initial set elapsed time period T0.

13. The induction heating cooker according to claim 11, wherein the control portion is adapted to determine that the stewing cooking is being performed, when the measured cooking time period Tp measured by a first time-measurement portion until the temperature indicated by the infrared-ray detection information has reached a first set value smaller than the second set value is equal to or longer than the initial set elapsed time period T0.

* * * * *